United States Patent [19]

Rokas

[11] 4,443,277

[45] Apr. 17, 1984

[54] METHOD OF MAKING A TELECOMMUNICATIONS CABLE FROM A SHAPED PLANAR ARRAY OF CONDUCTORS

[75] Inventor: Bernard E. Rokas, Ormeaux, Canada

[73] Assignee: Northern Telecom Limited, Montreal, Canada

[21] Appl. No.: 422,021

[22] Filed: Sep. 23, 1982

[51] Int. Cl.[3] ..... H01B 13/10

[52] U.S. Cl. ..... 156/50; 156/51; 156/55; 156/201; 156/324; 174/34; 174/131 A; 428/376; 428/377

[58] Field of Search ..... 156/50, 51, 54, 55, 156/296, 324, 201; 174/34, 131 A; 428/375, 376, 377

[56] References Cited

U.S. PATENT DOCUMENTS

| | | | |
|---|---|---|---|
| 3,282,666 | 11/1966 | Gallagher et al. | 156/296 X |
| 3,315,740 | 4/1967 | Withers | 156/296 X |
| 4,022,647 | 5/1977 | Yevick | 156/255 X |

*Primary Examiner*—Robert A. Dawson
*Attorney, Agent, or Firm*—R. J. Austin

[57] ABSTRACT

Telecommunications cable formed by locating a plurality of conductors in a group in an open array, which is preferably planar, and shaping the group into arcuate configuration around a longitudinal axis with the conductors extending generally in the direction of the axis. A layer of insulation is then provided around the group to hold it in its planar configuration.

13 Claims, 14 Drawing Figures

METHOD OF MAKING A TELECOMMUNICATIONS CABLE FROM A SHAPED PLANAR ARRAY OF CONDUCTORS

This invention relates to telecommunications cable.

Telecommunications cable is known designed specifically for use inside building for connecting telephone services to outside lines. A telecommunications cable for use inside buildings is normally led through ducting or behind walls and issues into rooms through bases of the walls to be connected to telephone equipment. Because of the nature of the connections to the equipment and/or the distance of the equipment away from the walls, it is sometimes convenient or even necessary to provide a flat cable from the walls to the connections. Flat cables are cables which have insulated conductors disposed in a group in a substantially flat arrangement by a carrier to provide a tape type structure in that there is substantial width across the cable while the cable is extremely thin in a direction normal to the width. Such flat cables may conveniently be passed beneath carpets and across a room without any inconvenience underfoot to users of the equipment. Flat cables are also useful when the conductors have to be connected to "in-line" terminals of a connector.

Flat cable connectors are connected to suitably made flat cables simply and quickly by piercing the flat cable with the terminals. However, when round cables are connected to flat cables, making the connections between the conductors is a time consuming exercise as the individual conductors of the round cable need to be joined to one side of a flat cable connector individually before the other side of the flat cable connector carrying the flat cable is connected to it. At the present, there is no way of avoiding these connections by the use of flat cable instead of round cable as the flat cables are unsuitable for passage behind walls and through ducting and they do not provide all of the flexibility and maneuverability requirements of a round inside telecommunications cable.

The present invention is concerned with a method of making a telecommunications cable and also relates to a telecommunications cable structure which avoids the problems discussed above.

According to the present invention, there is provided a method of making a telecommunications cable comprising:

disposing a plurality of insulated conductors together into a conductor group in which the conductors are in open array in a direction normal to a longitudinal direction of the group and retaining the conductors in their relative positions in the group;

shaping the group into an arcuate configuration around a longitudinal axis with the conductors extending in the general direction of the axis; and providing a layer of insulation extending around the axis and surrounding the group in its arcuate configuration.

Preferably, the conductor group is formed in an arcuate configuration with side edges of the group brought into close proximity with one another. Alternatively, the group is wrapped around itself to provide a closed wrapped structure with at least one longitudinally extending portion of the group overlying another. To help provide flexibility to the cable, the arcuate configuration is conveniently substantially circular in a cross-section taken normal to the longitudinal axis and flexibility is also improved by twisting the arcuate configuration around the longitudinal axis to give it a helical twist with the conductors also being helically disposed.

In the above method of making telecommunications cable, conveniently the conductors may be arranged in pairs of twisted or parallel conductors and the pairs are disposed in the array in the group. Alternatively, the conductors are untwisted and be parallel to one another.

The array is conveniently and practically formed as a substantially planar array. However, the array may have slight curvature in cross-section normal to the longitudinal direction of the group.

To retain the conductors in their relative positions in the group, the conductors may be fed from storage spools through a group forming station in which they are applied to one surface of an adhesive tape and the tape holds them in the group during the remainder of the cable forming process. As an alternative, the tape is fed through the group forming station simultaneously with the conductors and an adhesive is applied to the tape and conductors at the group forming station to hold the conductors to the tape. As a further alternative, the group forming station, there is disposed an extruder head having a slit die to which the conductors are passed to locate them in the group. Simultaneously, with the passage of the conductors through the slit die, the conductors are embedded into a layer of polymeric material which is extruded in strip form from the die orifice.

The above process according to the invention, provides a telecommunications cable having a group of conductors arranged in arcuate configuration from an open array beneath the insulation layer. Upon removal of the insulation layer at either end or along any length of cable between the ends, then the exposed group of conductors may be unwound from their arcuate configuration into their original arcuate configuration to act as a flat connectable cable to be connected to a flat cable connector. Obviously, when the group is in its planar configuration, after removal of the insulation, then it has the advantages of a conventional flat cable in its connection capabilities to equipment or in its unobtrusive passage under a carpet and across a room for connection to remotely disposed equipment.

The invention also provides a telecommunications cable comprising a plurality of insulated conductors disposed together in a arcuate group extending around a longitudinal axis and a layer of insulation extending around the axis and surrounding the arcuate group, the arcuate group capable of being shaped from arcuate into planar configuration upon removal of the layer of insulation.

Embodiments of the invention will now be described by way of example, with reference to the accompanying drawings, in which.

Figure 1:
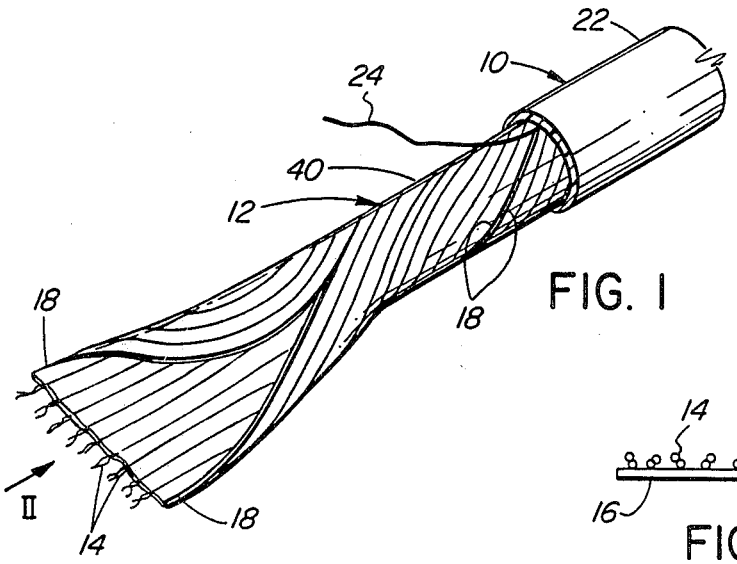
FIG. 1 is an isometric view of part of a cable according to a first embodiment with part of an outer jacket layer removed.
Figure 2:
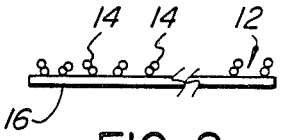
FIG. 2 is an end view of a group of insulated conductors of the cable taken in the direction of arrow II in FIG. 1.

According to a first embodiment, a telecommunications cable 10 comprises a group 12 of insulated conductors 14 which are arranged in twisted pairs of communications conductors as shown in FIGS. 1 and 2. As shown by FIG. 2, the group 12 is made in a substantially planar configuration in a cross-section normal to the longitudinal direction of the group in that the pairs of twisted conductors 14 lie in substantially parallel relationship in the group in side-by-side positions with the group carried upon a holding material which is an adhesive support tape 16. In the cable 10, the group 12 lies in arcuate form around the axis of the cable by the side edges 18 of the tape 16 having been turned around the axis to lie in close proximity, e.g. abutting, as shown by FIG. 1. The group 12 also extends helically along the cable with the side edges 18 and twisted pairs thus being helical. Around the helically formed group of conductors is disposed an annular insulation layer or jacket 22 which is formed from a flexible plastic, typically a polyvinylchloride composition. Alternatively, the jacket 22 may be formed from some other polymeric material such as polyethylene, or florinated polymeric materials for instance as sold under the trademarks Kynar, Hayler, Teflon. Such cables could also include a core wrap of various materials.

The cable is thus a round cable having the characteristics of strength and flexibility for round cable to enable it to be installed without difficulty throughout a building, i.e. within ducts and behind wall structures. The jacket thickness, e.g. up to or around 30 mil, and typically 30 mil, is compatible with the flexibility requirements. In addition, the helical disposition of the conductors 14 also promotes the flexibility requirements. As it will be required to remove certain lengths of the jacket to expose the conductors for making connections at terminals, then it is convenient to provide some means for enabling the jacket to be removed quickly and easily. For this purpose, a sufficiently strong rip cord 24 is provided and this cord extends longitudinally beneath the jacket on the outside of the helical formation of the group 12 of conductors. The rip cord may be made from nylon monofilament or any other suitably strong material.

Figure 3:
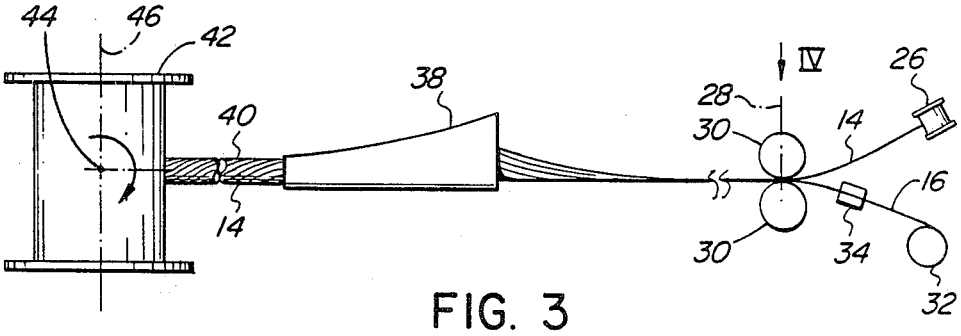
FIG. 3 is a diagrammatic side elevational view of apparatus for making the group of insulated conductors of FIG. 2.
Figure 4:
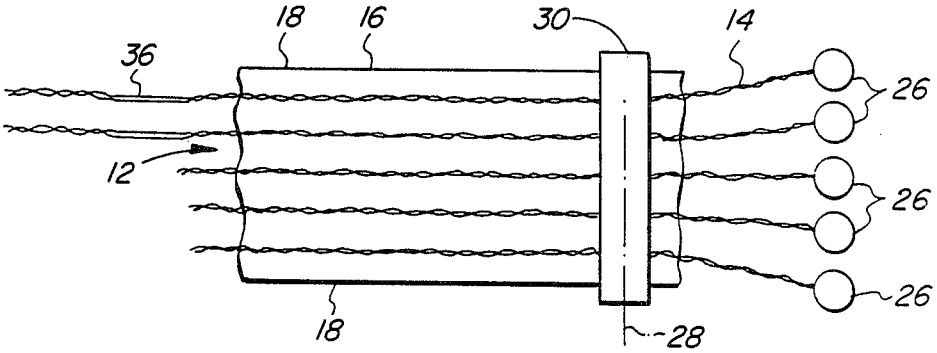
FIG. 4 is a view in the direction of arrow IV—IV of part of the apparatus of FIG. 3.

In the manufacture of the cable shown in FIG. 1, the planar group of conductors is first formed. As shown by FIG. 4, the pairs 14 of twisted conductors are mounted on spools 26 at one end of apparatus for forming the flat group of conductors. The flat group is formed by feeding the pairs of conductors through a group forming station 28 in which are disposed two coacting pressure rolls 30. As shown by FIGS. 3 and 4, the pairs of conductors are passed through the nip between the rolls together with the adhesive coated tape 16 fed from spool 32. The adhesive on the tape is heat activated and to cause the conductors 14 to adhere to its surface, it is passed through a heating chamber 34 before proceeding to rolls 30.

After passing through the rolls 30, as shown by FIG. 4, the twisted pairs of conductors 14 lie substantially in parallel alignment along the upper surface of the tape 16 to which they are adhesively secured. The spools 26 are arranged so that the pitches in the pairs of conductors are designed not to coincide at any particular section along the length of the group. The twist of each pair of conductors varies along its length and the variation in the pairs is out of phase. The reason for this is to minimize the degree of crosstalk from one pair of conductors to another. As shown by FIG. 4, each twisted pair of conductors is provided with straight untwisted sections 36 which extend for a short distance, for instance about 2" and these short sections are spaced apart by longer distances of several feet, for instance two or more feet. FIG. 4 shows the spools 26 are arranged in such a way that the straight sections 36 of the pairs coincide along a short length 16 of the tape. The finished cable is cut at any straight section 36. There is no need, therefore, to unravel the twist of the conductors of the pairs for connections to be made to terminals or connectors.

After formation of the group 12 upon the tape 16, the tape bearing the group is fed through a guide 38 (FIG. 3) having a curved guide surface for turning the side edges 18 of the tape 16 around the longitudinal axis of the tape to form the tape into a cylinder with the side edges 18 butted together. The construction of the guide 38 is similar to the guides used for applying core wraps around cores of electrical conductors during the manufacture of cables and will be described no further.

The cylindrically shaped tape 40, as it leaves the guide 38, has the electrical conductors extending substantially parallel to the longitudinal direction. Also, at this stage, the abutted edges 18 of the tape lie strictly in the longitudinal direction and are positioned at the top of the formed tape. The group 12 of conductors is then coiled onto a spool 42 as shown in FIG. 3. Spool 42, while rotating to coil the tape onto it, is also rotated about an axis 44 (FIG. 3) passing through its median plane at 90° to the spooling rotation axis 46. The axis 44 is parallel to the longitudinal axis of the cylinder 40. Rotation of the spool about the axis 44 twists the cylinder 40 so as to helically form it as it moves between the guide and the spool 42 during spooling whereby the side edges 18 and the conductors 14 take on the helical disposition shown in FIG. 1 for the cylinder 40.

Figure 5:
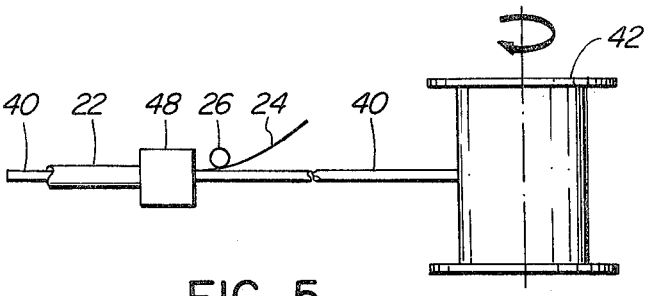
FIG. 5 is a diagrammatic side elevational view of apparatus for applying the outer jacket layer to the group of conductors.

To provide the jacket 22 upon the tape 16 and the conductors 14, the spool 42 is removed from the apparatus of FIG. 3 and is located upstream of a suitable jacket extrusion apparatus 48, which is shown diagrammatically in FIG. 5. The cylinder 40 is then unspooled from the spool 42, without the spool rotating about its axis 44, whereby the helical formation in the conductors and the side edges 18 is maintained. The cylinder 40 is passed through the extrusion head together with the rip cord 24 which is fed beneath a guide roll 26 to position it against the outside of the cylinder 40 as it enters the extrusion head. As shown in FIG. 5, on the downstream side from the extrusion head, the cylinder 40 is covered in the jacket 22.

Figure 6:
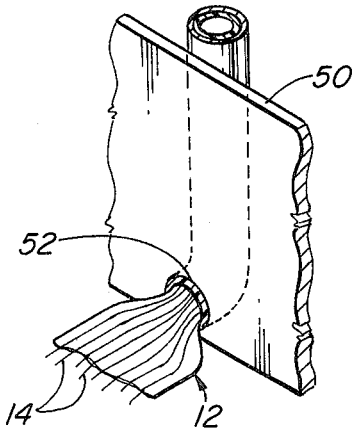
FIG. 6 is a perspective view of part of a wall inside a building and showing a method of installing the cable of FIG. 1.

In use of the cable of the first embodiment, the cable is laid in conventional manner through air plenems or ducting behind walls 50 in a building, as shown by FIG. 6. The cable provides flexibility and strength for a normal round cable for this particular function. Upon the cable issuing from a hole 52 in the base of the wall, it may either continue in its round form or it may be converted conveniently, into a flat cable for passage beneath a carpet or for connection to a "in-line" connector or terminal of telephone equipment immediately nearby. In either case, the cable jacket is removed for a distance along the cable to expose a sufficient length of the cylinder 40 to enable the cylinder to be unrolled to extend in its planar form, i.e. as flat cable, for the required distance. With the cable in its flat form as shown in FIG. 6 when installed in a building, it is a relatively simple matter to connect it to a flat cable connector for use with telecommunications equipment. Thus any problems associated with the connecting of round to flat cable are completely avoided with the invention and as described in the first embodiment, and also the advantages are obtained in installation of a round cable through plenums and behind walls in a building.

Figure 7:
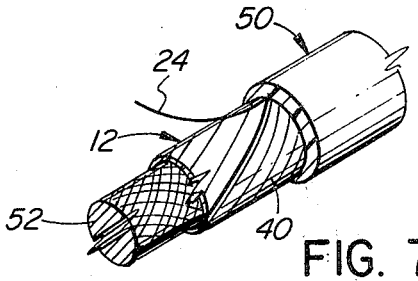
FIG. 7 is a view similar to FIG. 1 of a cable according to a second embodiment.

In a second embodiment, as shown by FIG. 7, a round cable 50 is basically of the same structure as shown by FIG. 1 and the same reference numerals are used for similar features. The structure of cable 50 differs from that of the first embodiment solely in that the group 12 of conductors surrounds a central core 52 of flexible material such as a cord of braided structure or rubber. This central core is provided for the purpose of giving strength to the cable structure and to enable the cable to be twisted along tortuous paths, through plenums and behind walls without the cable collapsing inwardly upon itself.

The cable of the second embodiment is made in the manner described with regard to the first embodiment with the sole difference being that as the group of conductors is fed towards the guide 38 shown in FIG. 3, then the core 52 is fed by a guide roller (not shown) onto the upper surface of the group of conductors immediately before the conductor group is formed into its cylindrical form whereby the cylinder is caused to encircle the core 52.

Figure 8:
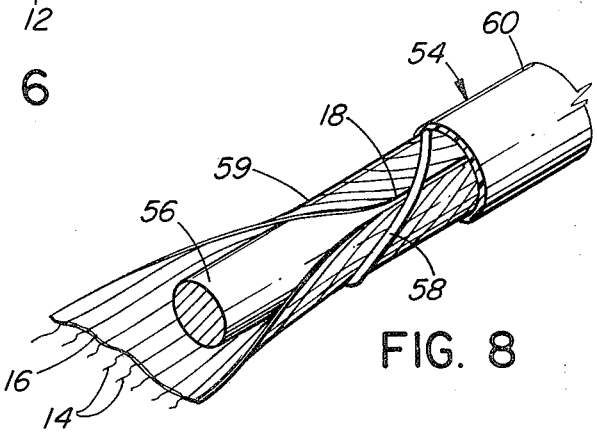
FIG. 8 is a view similar to FIG. 1 of a cable according to a third embodiment.

In a third embodiment, as shown by FIG. 8, a cable 54 comprises a group of conductors 12 held upon the tape 16 and made in the manner described in the first embodiment. The tape is wrapped around a central core 56 with the conductors extending solely in the axial direction as shown by the Figure. In this structure, the butting edges 18 of the tape also extend in a solely axial fashion. A binding cord 58 extends helically around the thus formed cylinder 59 and the conductors and the binding cord are surrounded by an insulating polymeric jacket 60 similar to the jacket 22.

Figure 9:
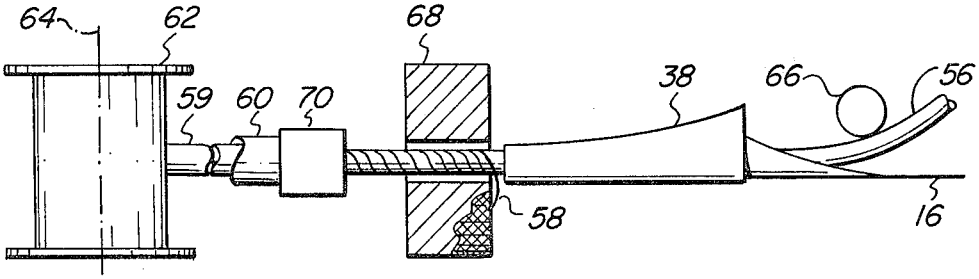
FIG. 9 is a diagrammatic side elevational view of apparatus for making the cable of FIG. 8.

During manufacture of the cable of the third embodiment, shown by FIG. 9, the planar assembly of conductors and tape 16 is fed through a guide 38 as shown in the first embodiment for turning the assembly into its cylindrical form 59. Because the conductors are not disposed helically in the finished construction, then the cylindrical form of the conductors is merely spooled onto a reel 62 which is rotating about a major axis 64 for the spooling process without the spool rotating about any other axis. To provide strength to the finished cable, the cylinder 59 is formed around the core 56 which is guided around a roller 66 and onto the group of conductors before entering into the guide 38. As the formed cylinder 59 leaves the guide, the binder 58 is wrapped around the cylinder from a conventional binding head 68 as shown in FIG. 9. This prevents any tendency for the cylinder 59 to unwrap itself before passage of the cylinder through an extrusion head 70, shown in FIG. 9. Because the conductors are not subjected to the helical winding operation which takes place in the first embodiment, then in the third embodiment, the cylinder 59 wrapped around the core 56 and carrying the binder 58 may move directly from the binding head through the extrusion head 70 wherein the jacket 60 is applied. Thus, with the manufacture of the structure of the third embodiment, the cable may be made and spooled completely in one operation without the necessity of proceeding through an intermediate spooling operation as in the first embodiment and prior to the jacket forming process.

The cable of the third embodiment has advantages as discussed with regard to the first embodiment.

To remove the jacket 60 of the cable 54, it may be preferable to have a rip cord (not shown) as in the first embodiment. However, it may be found that if suitable tensile material is used for the binder 58, then the binder may also operate as a rip cord for removal of the jacket.

Figure 10:
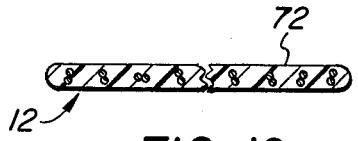
FIG. 10 is a view of the end of a group of insulated conductors of the cable forming a fourth embodiment.
Figure 11:
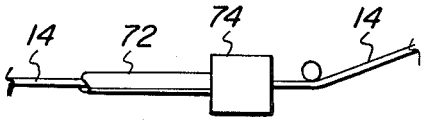
FIG. 11 is a diagrammatic side elevational view of apparatus utilizing the conductor group of FIG. 10.

In a fourth embodiment, the group of conductors is held differently. In FIG. 10, the group 12 of conductors is held within a flat extruded web 72 of insulating polymeric material such as polyethylene or polyvinylchloride. This web adds strength to the structure. Upon the wrapping the group of conductors with the web into its cylindrical form, it may be found that a central core, such as core 56 in FIG. 8, may be absolutely unnecessary for strength requirements. With the structure shown in FIG. 10, to provide the web, the conductors are fed through an extruder 74, for instance as shown by FIG. 11, instead of being passed between rollers for securement to an adhesive tape. The extruder head is of slit form and the conductors 14, upon leaving the extruder, are embedded securely in the web 72 of material as shown by FIG. 11.

The above embodiments show the formation of a cylinder from the group of conductors in which side edges of the holding material, e.g. the tape 16 or web 72 substantially abut together. However, the invention is not limited to such a structure. The arcuate configuration of the holding material may be open with side edges spaced apart so that a cylinder is not formed.

Figure 12:
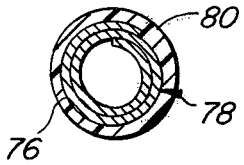
FIG. 12 is a cross-sectional view through the axis of a cable according to a fifth embodiment.

Alternatively, the holding material may be wrapped around itself to form two or more layers of conductors in the finished cable. For instance, as shown in a fifth embodiment by FIG. 12, two complete wrappings of tape 76 bearing pairs of twisted conductors 14 are formed to provide a tightly wound cylinder 78 which preferably has the conductors in helical formation. After removal of the jacket 80, the tape 76 may be unwound to return it to a planar configuration as described in the other embodiments.

Figure 13:
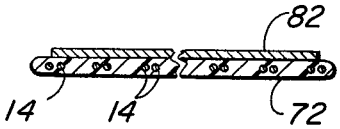
FIG. 13 is an end view of a group of insulated conductors to form part of a cable which is a modification of the embodiment of FIG. 10.

In a modification of the fifth embodiment, the conductors do not form twisted pairs. Instead, the conductors of each pair extend in untwisted and parallel relationship. These conductors 14 may be provided upon one surface of a flat tape or, as shown in FIG. 13, may be embedded in an extruded web 72 of plastics material.

Figure 14:
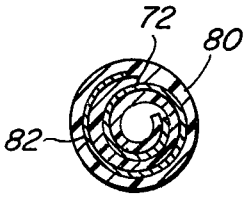
FIG. 14 is a view similar to FIG. 12 of the modification of the conductors of FIG. 13.

As untwisted conductors may produce inferior cross-talk capabilities, a metal shield will be necessary between the adjacent layers of conductors. This shield is conveniently in the form of metal foil 82 (FIG. 13). In the planar form, the web 72 and the metal foil 82 are placed together before being wrapped into the form of FIG. 14.

What is claimed is:

1. A method of making a telecommunications cable comprising:

disposing a plurality of insulated conductors together into a conductor group in which the conductors are in open planar array in a direction normal to a longitudinal direction of the group and retaining the conductors in their relative positions in the group;

shaping the group into an arcuate configuration around a longitudinal axis with the conductors extending in the general direction of the axis; and providing a layer of insulation extending around the axis and surrounding the group in its arcuate configuration.

2. A method according to claim 1, comprising retaining the conductors in open array by the use of a flexible holding material having longitudinally extending side edges, and turning the side edges towards each other to form the material into substantially cylindrical configuration.

3. A method according to claim 2, wherein the side edges are brought into close proximity with one another.

4. A method according to claim 3, comprising turning the side edges of the holding material around a longitudinally extending core.

5. A method according to claim 3, comprising twisting the cylindrical configuration to provide helical paths for the conductors around said longitudinal axis.

6. A method according to claim 2, wherein a binding tape is wrapped around the cylindrical configuration before the layer of insulation is applied.

7. A method according to claim 2, wherein the layer of insulation is applied to the insulation by extending polymeric insulating material around the cylindrical configuration.

8. A method according to claim 7, wherein the layer of insulation is formed with spaced apart holes passing through the insulation.

9. A method according to claim 2, wherein the holding material is wrapped around itself and around the longitudinal axis to provide at least two layers of conductors.

10. A method according to claim 2, comprising winding the cylindrical configuration onto a spool while rotating the spool around the longitudinal axis to twist the cylindrical configuration to provide helical paths for the conductors around said longitudinal axis, unspooling the cylindrical configuration while retaining the helical paths of the conductors, and extruding the layer of insulation around the cylindrical configuration.

11. A method according to claim 2, comprising passing the flexible holding material carrying the conductors through a turning guide to form the material into substantially cylindrical configuration and passing the cylindrical configuration downstream from the guide and extruding a polymeric insulating material onto it to provide the layer of insulation.

12. A method according to claim 2, comprising providing the flexible holding material as a support tape and retaining the conductors in open array by holding them onto the support tape by an adhesive.

13. A method according to claim 2, comprising holding the conductors in open array by extruding around them a web of insulating material which provides the flexible holding material.

* * * * *